United States Patent [19]

Frano et al.

[11] 4,161,816

[45] Jul. 24, 1979

[54] METHOD OF MAKING RELAY AND RF ADAPTOR ASSEMBLY

[75] Inventors: Paul A. Frano, Windsor Locks; Robert W. Bowman, Enfield; Donald F. Drapeau, Windsor; Marino Kain, Bloomfield, all of Conn.

[73] Assignee: Hi-G, Incorporated, Windsor Locks, Conn.

[21] Appl. No.: 864,833

[22] Filed: Dec. 27, 1977

Related U.S. Application Data

[62] Division of Ser. No. 631,874, Nov. 14, 1975, Pat. No. 4,109,222.

[51] Int. Cl.[2] ..... H01R 43/00

[52] U.S. Cl. ..... 29/628; 174/35 C; 174/DIG. 8; 325/357; 339/143 R; 339/DIG. 1

[58] Field of Search ..... 335/219, 301; 174/35 R, 174/35 C, DIG. 8; 339/143 R, 147 R, DIG. 1; 325/357; 29/602 R, 628

[56] References Cited

U.S. PATENT DOCUMENTS

| | | | |
|---|---|---|---|
| 3,435,387 | 3/1969 | Reinke etal. | 339/147 R |
| 3,525,799 | 8/1970 | Ellis | 339/DIG. 1 X |
| 3,825,874 | 7/1974 | Peverill | 339/143 R X |

*Primary Examiner*—Carl E. Hall

*Attorney, Agent, or Firm*—Hayes & Reinsmith

[57] ABSTRACT

A plurality of contact pins project from a flat header of a miniature relay for connection to a corresponding number of coaxial cables. A separate radio frequency adaptor is provided having a plurality of hollow cable connector receiving shells and a planar supporting base interconnecting the shells with the shells serving as RF shields for the header pins.

The process of making the RF relay assembly includes mounting the header pins in a predetermined layout on the relay header, forming a one-piece adaptor by interconnecting the tubular shells in a pattern corresponding to the header pin layout and then securing the one-piece RF adaptor to the relay header with each header pin in a complementary shell and with each shell made common with electrical ground.

6 Claims, 3 Drawing Figures

METHOD OF MAKING RELAY AND RF ADAPTOR ASSEMBLY

This is a division of application Ser. No. 631,874, filed Nov. 14, 1975, issued as U.S. Pat. No. 4,109,222 on Aug. 22, 1978.

This invention generally relates to electromagnetically actuated switching devices and particularly concerns an improved miniature relay for radio frequency (hereinafter called RF) switching applications.

A primary object of this invention is to provide a new and improved miniature relay for use in high frequency circuits requiring high operating reliability and which has a unique shield construction particularly adapted to achieve the desired operating reliability and durability for effective trouble-free switching of RF signals. Included in this object is the provision of a new and improved RF adaptor having a compact rugged structure for adapting relays and switches for use in RF circuits and which is an entirely separate component particularly suited to eliminate normal inventory problems of stocking a multiplicity of different types of RF relays by virtue of the unusual versatility of the adaptor construction to customize different relays with a variety of RF adaptors for specific applications.

Another object of this invention is to provide a relay of the type described having a minimum number of component parts which are quick and easy to assemble in a manufacturing operation and which assures the required electrical contact between a coaxial cable and a relay header pin in a highly economical assembly operation without sacrificing operational reliability.

A further object of this invention is to provide a relay of the type described featuring a significantly improved integral construction which effectively shields external signal-carrying terminal pins from undesired RF leakage. Included in this object is the aim of providing such a relay characterized by improved contact continuity and ease of low temperature assembly which reduces contact degradation and minimizes protective plating and cleaning requirements.

Yet another object of this invention is to provide a new and improved method of making a miniature RF relay wherein the steps required in the manufacture of the finished relay assembly not only are minimized but are significantly simplified while yet providing a properly shielded unit to be utilized in an RF circuit without requiring specialized RF connectors to switch RF signals.

Still another object of this invention is to provide a method of the type described wherein a one-piece RF adaptor is attached to a relay header utilizing a preform of conductive thermosetting adhesive film for attaching the RF adaptor to the header in a significantly simplified low temperature process.

Other objects will be in part obvious and in part pointed out more in detail hereinafter.

A better understanding of this invention will be obtained from the following detailed description and the accompanying drawings of illustrative applications of the invention.

Figure 1:
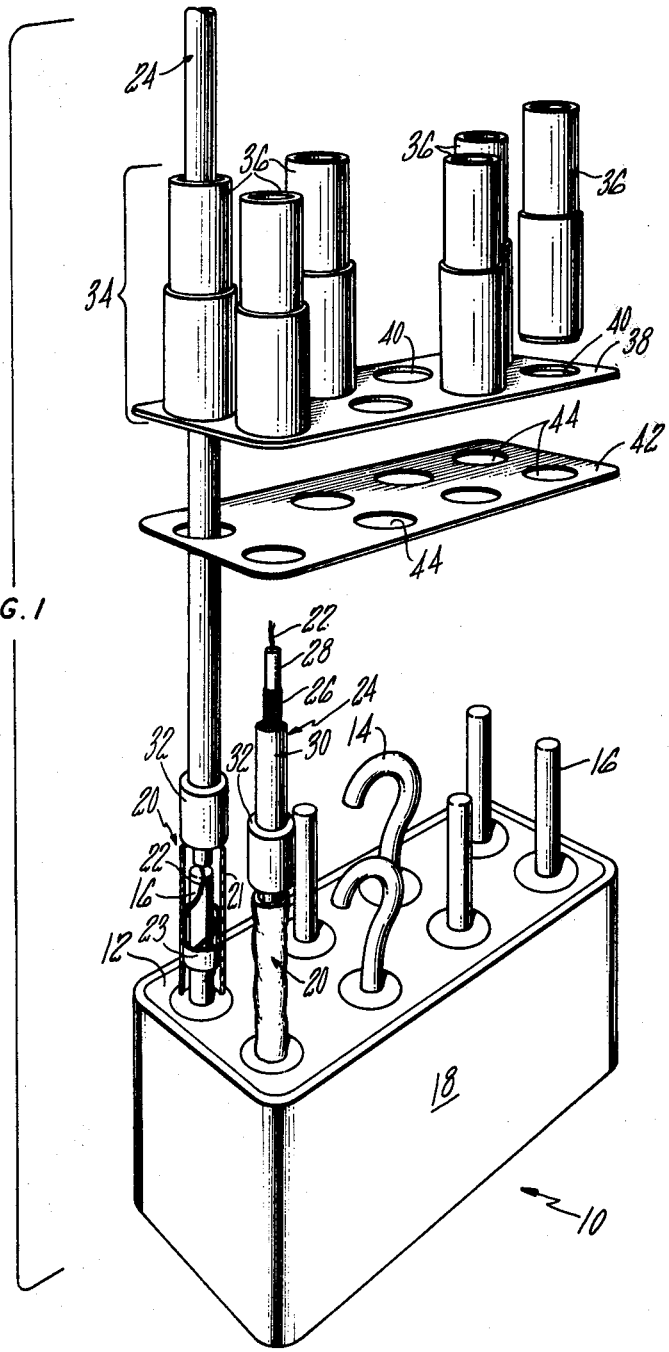
FIG. 1 is a fragmentary isometric view, partly broken away and partially exploded, showing a relay assembly incorporating this invention.

Referring now to the drawings in detail, FIG. 1 shows one embodiment of this invention wherein a conventional miniature relay 10 is depicted having an electrically conductive flat header 12 on which an array of relay terminals 14 and contact pins 16 are mounted to project in generally perpendicular relation from the header 12. Pins 16 establish electrical connection to a contact actuation assembly (not shown) inside a case 18 which houses the operating structure of the relay 10 and is sealed to its header 12. The pins 16 are each suited to be permanently connected to a coaxial cable center conductor 22, by soldering, welding, or other means, utilizing a connective device 20. Connective device 20 is shown having a heat shrinkable plastic sleeve 21 and an internal solder band 23 suited to be fitted about the conductor 22 and pin 16 before heat is applied to melt the solder band 23 and shrink the sleeve 21 to permanently fix device 22 to pin 16.

Coaxial cable 24 is of a conventional type having a conductive braided shield 26 surrounding the center conductor 22 with the braided shield 26 concentrically interposed between inner and outer insulating jackets 28 and 30 respectively surrounding the center conductor 22 and the braided shield 26. Each cable 24 has a lead end which is to be connected to its respective header pin 16 and is preassembled with a conductive sleeve 32 surrounding the outer jacket 30 of cable 24 adjacent an exposed end of its center conductor 22, the braided cable shield 26 being understood to be soldered or otherwise suitably connected to the sleeve 32.

In the past, very real problems have been experienced with miniature relay switching in radio frequency circuits, resulting in undesired RF leakage paths and unreliable performance when the relay is required to effect switching applications at high frequencies. This invention effects a solution for such problems by the provision of a unique one-piece RF adaptor 34 which desirably provides a simplified structural arrangement and an unusually economical method of assembly of an RF relay which has been found to exhibit significantly improved operational reliability in a rugged miniature assembly.

Moreover, contrary to the teachings of certain conventional techniques involving miniature relays the particular assembly of this invention achieves seemingly imcompatible objectives of providing a permanently secured RF adaptor and relay assembly which features complete access during its construction to the junction of the coaxial cable center conductor and its relay pin when desired to effect permanent factory mounting of the electrical connection between the cable and its header pin, while also assuring low temperature assembly of the header and adaptor to minimize contact degradation. Significant additional advantages are also obtained by this invention which is particularly designed to ensure that the relay and adaptor components are completely and independently processed and finished before assembly as a completed RF unit.

More specifically, to interconnect a plurality of cable connector receiving shells 36 in a uniquely simplified but rugged structure wherein electrically conductive tubular shells 36 may be selectively prepositioned in an array matching the header pins 16 to be shielded, the RF adaptor 34 is provided with an electrically conductive planar supporting base 38 having a plurality of prepunched holes 40 corresponding to the terminal layout pattern of the external pins 16 and terminals 14 projecting from the header 12. A shell 36 is fitted into each of the holes 40, corresponding to a header pin 16, to project coaxially relative to the header pin 16 in concentric relation thereto upon assembling the RF adaptor base 38 to the header 12.

By virtue of the disclosed construction, it will be seen that a complete RF relay unit may be customized as desired for a particular application simply by the selection of a particular relay and corresponding RF adaptor which are then bonded together to quickly and easily produce the required finished RF relay unit.

The adaptor shells 36 are secured to the base 38 to form an integral component by soldering, brazing, welding, or other means such as by a threaded connection, peening, riveting and the like which will ensure an electrically common connection between each shell 36 and the base 38.

Moreover, the disclosed one-piece construction of the RF adaptor 34 permits this part, and the relay 10, to be processed and completed as separate entities, including protective plating, and thereafter stocked as such. The normally troublesome plating of blind holes encountered in certain other processing methods is obviated, together with the insulation resistance failures caused by trapped plating solution and salts which has frequently required repeated cycles of reworking and special processing to remove unacceptable residues. A note-worthy advantage of the disclosed construction is the ease with which the coaxial cable 24 may be attached to its header pin 16 before assembling the RF adaptor 34 and relay 10. Complete access is provided to each center conductor, connective device 20, and relay pin 16 junction to allow these joints to be first welded or soldered or otherwise permanently joined, if desired, securing the RF adaptor 34 and relay 10 in assembly.

To secure the adaptor 34 to the header 12 of the relay 10 in a process particularly suited for relatively low temperature assembly such that the shells 36 are each made common to electrical ground and act as RF shields, a glass-supported silver epoxy adhesive film is provided in a preform 42 such as a sheet die cut to the form of the base 38 of the adaptor 34 for assembly between its base 38 and header 12. By the provision of the disclosed preform 42, the introduction of excessive heat into the relay contact area is effectively precluded with the assembly being effected under low heat and pressure such that the silver-filled thermosetting bonding agent flows and subsequently cures at about 125° Centigrade. Accordingly, the use of the disclosed epoxy adhesive preform 42 not only establishes a common electrical conductive path between the RF adaptor 34 and the header 12 but prevents undesired contact degradation which has been experienced in conventional assembly processes from the excessive heat given off in brazing and other techniques such as induction heating. The low temperature assembly achieved by the use of the epoxy bonding agent is quick and easy to form and has been found to effectively secure the component parts.

From the foregoing description of the invention, it is noted that the construction and assembly of the miniature relay is greatly facilitated by use of the two separate component parts. The header 12, while extremely small in size, is easily accessible to permit positive permanent connection of the coaxial cable center conductor 22 to its header pin 16. The center conductor 22 of each of the cables 24 is positively attached to its pin 16 utilizing the connective device 20 which is permanently secured to pin 16, by melting the solder band 23 and shrinking the sleeve 21 with forced hot air discharged from an air gun, not shown. The preform 42 of adhesive film is then positioned on the header 12 with the leads of the cable 24 being directed through die cut openings 44 in the preform 42. The RF adaptor 34 is then placed in position with the holes 44 of the preform 42 registering with the adaptor openings 40 and header pins 16, and the cable leads extended through the hollow shells 36. Thereafter the adaptor 34 is bonded to the relay 10. The sleeve 32 establishes the ground connection between the adaptor 34 and braid 26 of the coaxial cable 24, and this connection is established preferably by soldering around each of the sleeves 32 to their respective shell 36 of the RF adaptor 34. Upon completing the connection of cable 24 to adaptor 34, the required connections and assembly of the RF relay unit are finished.

Figure 2:
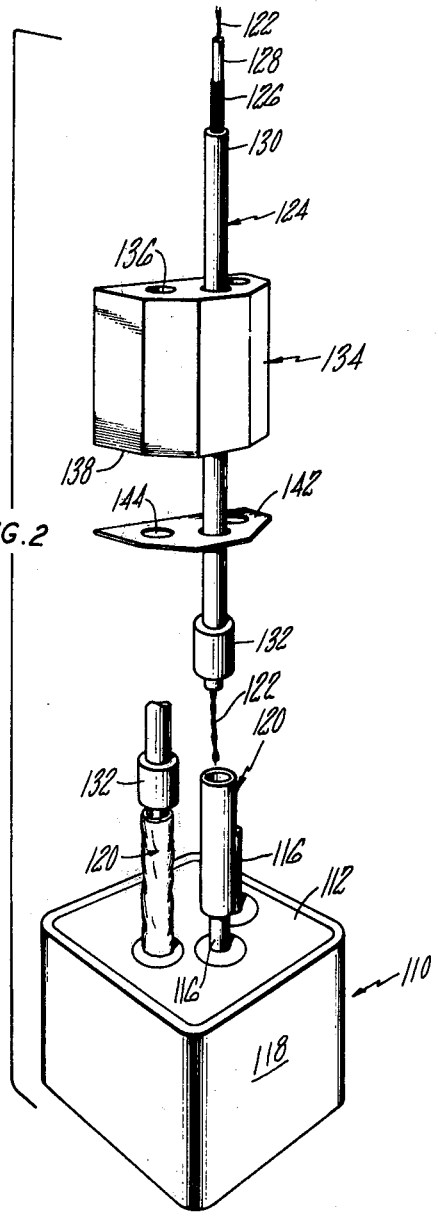
FIG. 2 is another embodiment of a relay incorporating this invention depicted in a fragmentary, exploded isometric view.

Another embodiment of this invention is illustrated in FIG. 2 wherein like parts are identified by the same numbers as those described in the embodiment of FIG. 1 but increased by 100. The adaptor illustrated in FIG. 2 utilizes a single block-like unit 134, such as an extrusion, casting or other suitable member formed of an electrically conductive material such as a metal or conductive coated plastic, which in turn is attached to the metal relay header 112 by an electrically conductive epoxy. The epoxy is shown, as in FIG. 1, in the form of a preform 142 of adhesive film which is prepunched with holes 144 to correspond to the relay pins 116 and which can be simply fitted onto the header 112 with the adhesive being interposed and coextensive between the confronting face of the header 112 and base 138 of the adaptor 134 after the center conductor 122 of cable 124 is affixed to its header pin 116 utilizing a connective device 120. As in the previous embodiment, heat and pressure is applied to effect flow of the bonding epoxy which is cured, and cable sleeve 132 is soldered to its adaptor shell 136 to complete the ground connection.

Figure 3:
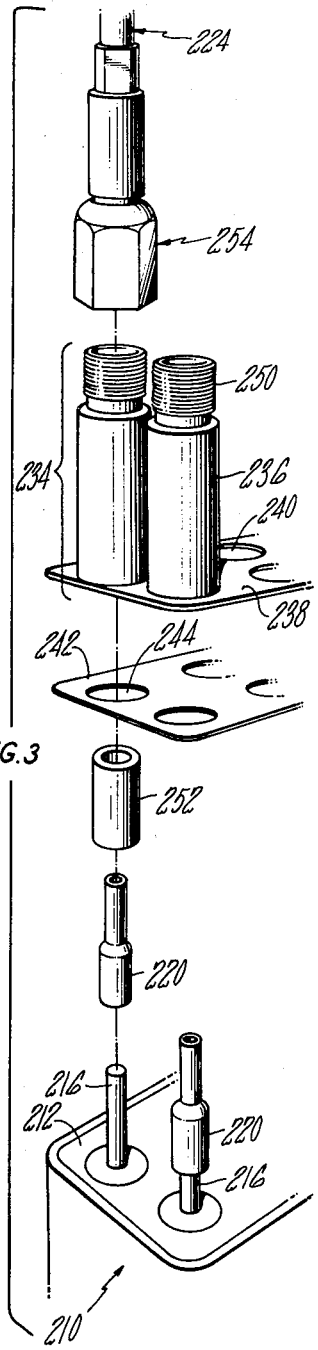
FIG. 3 is a view similar to FIG. 2 showing yet another embodiment of this invention utilized in a relay assembly particularly adapted for RF switching applications.

In the embodiment of the invention illustrated in FIG. 3, like parts are identified by the same numbers as in the embodiment of FIG. 1, but increased by 200. The assembly and the method of assembly is similar to that previously described, except that the upper open end of shells 236 are each externally threaded as at 250. The embodiment of FIG. 3 also provides for an insulation sleeve 252 which may be made of plastic or other suitable insulating material which surrounds the connective device or contact socket 220 and assists in maintaining alignment between contact socket 220 and its relay pin 216, it being understood that the contact socket 220 is preferably secured to pin 216 by a friction fit. The unit may be assembled with base 238 of adaptor 234 secured to header 212 by a bond established by epoxy adhesive preform 242, as described above in the embodiments of FIGS. 1 and 2, with the completed RF relay unit being supplied to the customer without having the electrical connections made between the pins 216 and the cables 224. The customer may provide such cables and use a special commercially available pin and socket screw-on connector 254 on the lead end of the coaxial cable 224 to establish the electrical connection between the cable 224 and relay 210.

It will be recognized that the capability of the relay is significantly enhanced for switching RF signals by the provision of the separate RF adaptor which contains the required number of shells made common to electrical ground to act as RF shields to enhance the RF switching characteristics of the basic relay unit. Introduction of excessive heat is precluded by the low temperature assembly, and the resulting construction is particularly rugged, considering the extremely small size of the relay and connectors involved, for effecting reliable repetitive switching applications under demanding conditions over an extended period of time.

From the foregoing description, it will be seen that the RF relay of this invention provides a design and method of assembly which provides for positive attachment of a coaxial cable center conductor to the relay terminal and which virtually eliminates contact continuity failure.

As will be apparent to persons skilled in the art, various modifications, adaptations and variations of the foregoing specific disclosure can be made without departing from the teachings of this invention.

We claim:

1. A method of making a miniature radio frequency relay assembly comprising the steps of mounting a plurality of radio frequency signal-carrying pins in a predetermined layout on an electrically conductive relay header with each pin projecting externally from the header for connection to a coaxial cable, forming a radio frequency adaptor as a one-piece component separate from the header by interconnecting tubular shells providing at least as many openings as there are radio frequency signal-carrying pins with the openings formed in a pattern corresponding to the RF signal-carrying pin layout ont the header, and securing the one-piece RF adaptor as an integral unit in electrically conductive relation to the relay header with each header pin received within the opening of a complementary shell, whereby the shells of the adaptor unit are made common with electrical ground and serve as radio frequency shields.

2. The method of claim 1 further including the step of permanently attaching a center conductor of a coaxial cable to each of the header pins, and then feeding each of the cables through a tubular shell corresponding to its respective header pin before effecting the securing step.

3. The method of claim 1 further including the step of fitting a heat shrinkable sleeve with an internal solder band over each pin with a center conductor of a coaxial cable interposed between the solder band and each pin, and then permanently attaching a center conductor of coaxial cable to each of the header pins by applying heat to each of the heat shrinkable sleeves.

4. The method of claim 1 wherein the adaptor forming step includes mounting a plurality of individual tubes on a supporting base having holes corresponding to the RF signal-carrying pin layout on the header by fitting a tube into each of said holes for the RF signal-carrying pins.

5. The method of claim 1 wherein the adaptor forming step includes forming said openings in an electrically conductive integral body with the material of the body surrounding said openings serving as the shells.

6. A method of making a miniature radio frequency relay assembly comprising the steps of mounting a plurality of radio frequency signal-carrying pins in a predetermined layout on an electrically conductive relay header with each pin projecting externally from the header, forming a one-piece radio frequency adaptor by interconnecting tubular shells to provide an integral adaptor unit having at least as many openings as there are radio frequency signal-carrying pins with the adaptor openings corresponding to the signal-carrying pin layout on the header, making a preform of electrically conductive thermosetting adhesive film, perforating the film to provide a series of holes matching said adaptor openings, positioning the preform between the relay header and the adaptor with the holes of the preform in registration with said adaptor openings and the radio-frequency signal-carrying pins, and then securing the one-piece RF adaptor as an integral unit in electrically conductive relation to the relay header by applying heat and pressure to bond the parts in assembly with each signal-carrying pin received within a complementary shell, whereby the shells of the adaptor unit are made common with electrical ground and serve as radio frequency shields.

* * * * *